US012589324B2

(12) United States Patent
Cai

(10) Patent No.: US 12,589,324 B2
(45) Date of Patent: Mar. 31, 2026

(54) MONEY BOX TOY ASSEMBLY STRUCTURE

(71) Applicant: Lina Cai, Shantou (CN)

(72) Inventor: Lina Cai, Shantou (CN)

( * ) Notice: Subject to any disclaimer, the term of this patent is extended or adjusted under 35 U.S.C. 154(b) by 0 days.

(21) Appl. No.: 19/083,771

(22) Filed: Mar. 19, 2025

(65) Prior Publication Data

US 2026/0048340 A1 Feb. 19, 2026

(30) Foreign Application Priority Data

Aug. 15, 2024 (CN) ..... 202421985025.7

(51) Int. Cl.
*A63H 33/30* (2006.01)
*A63H 33/06* (2006.01)

(52) U.S. Cl.
CPC ..... *A63H 33/30* (2013.01); *A63H 33/062* (2013.01)

(58) Field of Classification Search
CPC ..... A45C 1/12; A45C 2001/125; A63H 33/30
USPC ..... 446/8, 9, 10, 11, 12, 13
See application file for complete search history.

(56) References Cited

U.S. PATENT DOCUMENTS 237,757 A * 2/1881 Hunter ..... A45C 1/12 70/390
317,771 A * 5/1885 Hart ..... A45C 1/12 232/58
528,018 A * 10/1894 Nicol ..... A45C 1/12 232/6
664,990 A * 1/1901 Burns ..... A45C 1/12 232/58
718,908 A * 1/1903 Burns ..... A45C 1/12 232/58
1,152,097 A * 8/1915 Joseph ..... A45C 1/12 232/6
1,568,711 A * 1/1926 Berger ..... A45C 1/12 446/10
2,401,065 A * 5/1946 Gonzalez ..... A45C 1/12 220/284
2,622,365 A * 12/1952 Grow ..... G07F 17/105 60/39.511
2,628,028 A * 2/1953 Malnick ..... G07F 17/105 446/9

(Continued)

FOREIGN PATENT DOCUMENTS

CN 208448652 U 2/2019
CN 110506288 A 11/2019
CN 217939144 U 12/2022

*Primary Examiner* — Joseph B Baldori

(57) ABSTRACT

The present invention discloses a money box toy assembly structure, including a body and a door. The body includes a door frame, a top plate, a bottom plate, a back plate, a left side plate, and a right side plate. The door frame and the back plate are provided with slots; the top plate, the bottom plate, the left side plate, and the right side plate are provided with tongues; and the top plate, the bottom plate, the left side plate, and the right side plate are provided with side hooks. Through the cooperation of all components, children can complete the assembly without any additional tools. The easy-to-use and user-friendly structure facilitates children's learning of assembly skills through the play, to enhance interactivity. In addition, no assembly is required during manufacturing, so that a production cycle is shortened and manufacturing costs are lowered without assembly processes.

7 Claims, 5 Drawing Sheets

(56) References Cited

U.S. PATENT DOCUMENTS

| | | | | | |
|---|---|---|---|---|---|
| 2,728,310 | A * | 12/1955 | August | A45C 1/12 | 70/156 |
| 2,814,436 | A * | 11/1957 | Zietchick | A45C 1/12 | 232/4 R |
| 4,060,929 | A * | 12/1977 | Meyer | F21V 33/008 | 220/4.24 |
| 4,389,194 | A * | 6/1983 | Toll | G09B 19/025 | 109/1 R |
| 4,458,899 | A * | 7/1984 | Kanno | A63F 11/0002 | 273/138.3 |
| 5,074,819 | A * | 12/1991 | Stadnyk | A63H 33/00 | 446/478 |
| 5,282,765 | A * | 2/1994 | Suzuki | A63H 33/22 | 472/63 |
| 5,465,909 | A * | 11/1995 | Roth | A45C 1/12 | 232/1 D |
| 7,581,357 | B2 * | 9/2009 | Richardson | E04B 1/34321 | 52/79.5 |
| 7,980,918 | B1 * | 7/2011 | Prilutsky | A63H 33/062 | 446/478 |
| 8,789,745 | B1 * | 7/2014 | Barbary | A45C 1/12 | 446/8 |
| 9,033,758 | B2 * | 5/2015 | Burns | A45C 1/12 | 446/10 |
| 9,731,214 | B2 * | 8/2017 | Lindaman | A63H 33/008 | |
| 10,188,961 | B1 * | 1/2019 | Lee | A63H 33/084 | |
| 11,407,556 | B1 * | 8/2022 | Mathia | B65D 5/4212 | |

* cited by examiner

MONEY BOX TOY ASSEMBLY STRUCTURE

CROSS-REFERENCE TO RELATED APPLICATIONS

The application claims priority to Chinese patent application No. 202421985025.7, filed on Aug. 15, 2024, the entire contents of which are incorporated herein by reference.

TECHNICAL FIELD

The present invention relates to the technical field of building block toys, in particular to a money box toy assembly structure.

BACKGROUND

A money box is a container designed for storing coins. For easy access, a door is typically incorporated into the container. For example, the patent "CN218165965U" named "A MULTI-FUNCTIONAL MONEY BOX TOY" discloses a multi-functional money box toy, including a body, a door, an astronaut decorative component, a space robot rotating head, a button, a top cover, and a base. The body is movably connected to the door. The astronaut decorative component is installed on an outer surface of the door, and the space robot rotating head and the button are installed on the astronaut decorative component. The top cover is attached to an upper part of the body, and the base is fixed to the bottom of the body.

For another example, the patent "CN201691230U" named "SAFE-STYLE DEPOSIT BOX" discloses a safe-style deposit box, including a body, a coin slot and a coin access door that are disposed on the body. A password lock is disposed on the coin access door, and a counting circuit that counts the total amount of money deposited by the coin slot and a display screen that is connected to the counting circuit for displaying the total amount of money are disposed in the body.

Although an existing money box can be used for saving money, the body structure is more complex. In addition, a plurality of screws are required for assembly, with a cumbersome assembly process and high production costs. The structure needs to be assembled during manufacturing, resulting in a large size of a packaging box, and the structure is not convenient for transportation.

SUMMARY

In view of the foregoing deficiencies, the present invention aims to provide a money box toy assembly structure that is well-designed and easy to assemble, with a smaller size and less space after disassembly.

To achieve the foregoing objectives, the following technical solutions are provided in the present invention.

A money box toy assembly structure includes a body and a door, where the body includes a door frame, a top plate, a bottom plate, a left side plate, a right side plate, and a back plate; the door frame and the back plate are provided with slots on relative surface periphery positions, and the slots are provided with clamping protrusions; front and rear ends of the top plate, the bottom plate, the left side plate, and the right side plate are provided with tongues that are matched with the slots, and the tongues are provided with clamping holes that are matched with the clamping protrusions; and side hooks on the top plate, the left side plate, and the right side plate, and side hooks on the bottom plate, the left side plate, and the right side plate are matched with each other.

In a preferred solution of the present invention, left and right ends of the top plate and the bottom plate are provided with chamfered flanges, and upper and lower ends of the left side plate and the right side plate are provided with sockets that are matched with the shape of the chamfered flanges. Through the collaboration of the chamfered flanges and the sockets, the left side plate, the right side plate, the top plate, and the bottom plate are closely connected, with a more accurate alignment, to further enhance the stability of the structure.

In a preferred solution of the present invention, the side hooks on the top plate and the bottom plate are oriented in a same direction, the side hooks on the left side plate and the right side plate are oriented in a same direction, and the side hook on the top plate is opposite to the side hook on the left side plate. A mutual structure of the side hooks between the adjacent plates that are facing the opposite direction can prevent relative sliding between the plates, is not easy to loosen, and can achieve stable connection without additional fasteners. In this way, the stability and the durability of the overall structure are improved.

In a preferred solution of the present invention, the top plate is provided with a coin slot. The coin slot is set for a user to put in coins or banknotes, to realize a basic function of the money box.

In a preferred solution of the present invention, four corners of a bottom surface of the bottom plate are provided with supporting feet, with good placement stability.

In a preferred solution of the present invention, the clamping protrusion is an inverted hook, and the clamping hole is a square hole. The clamping protrusions and the clamping holes are well matched, and the design of the square hole is convenient for the accurate insertion of the clamping protrusion, to facilitate the assembly.

In a preferred solution of the present invention, the tongue is provided with a guide slot that extends along an insertion and unplugging direction of the tongue, and the slot is provided with a guide sheet that is matched with the guide slot. The guide slot and the guide sheet are well matched, to guide the tongue to be accurately inserted into the slot, and further simplify the assembly process. In addition, a position of the tongue on each plate is adjusted, to ensure error-proofing functions and prevent misassembly.

In a preferred solution of the present invention, one side of the door is provided with a hinged shaft, an inner side of the door frame is provided with a hinged slot that is matched with the hinged shaft, a notch of the hinged slot is provided with a fixed base, and the hinged shaft can be prevented from falling out of the hinged slot through the fixed base.

The beneficial effects of the present invention are that: the structure of the present invention is well-designed. Through the cooperation of the slots and the tongues, the clamping protrusions and the clamping holes, and the adjacent side hooks, the assembly and disassembly processes are simple and quick, and children can complete the assembly without any additional tools. The easy-to-use and user-friendly structure facilitates children's learning of assembly skills through the play. In addition, no assembly is required during manufacturing, so that a production cycle is effectively shortened and manufacturing costs are lowered without assembly processes. Components are stacked, to minimize the size and decrease the occupied volume during transportation to avoid excessive shipping costs. The compact structure also ensures convenient storage and portability for outdoor use.

DETAILED DESCRIPTION OF THE EMBODIMENTS

Figure 1:
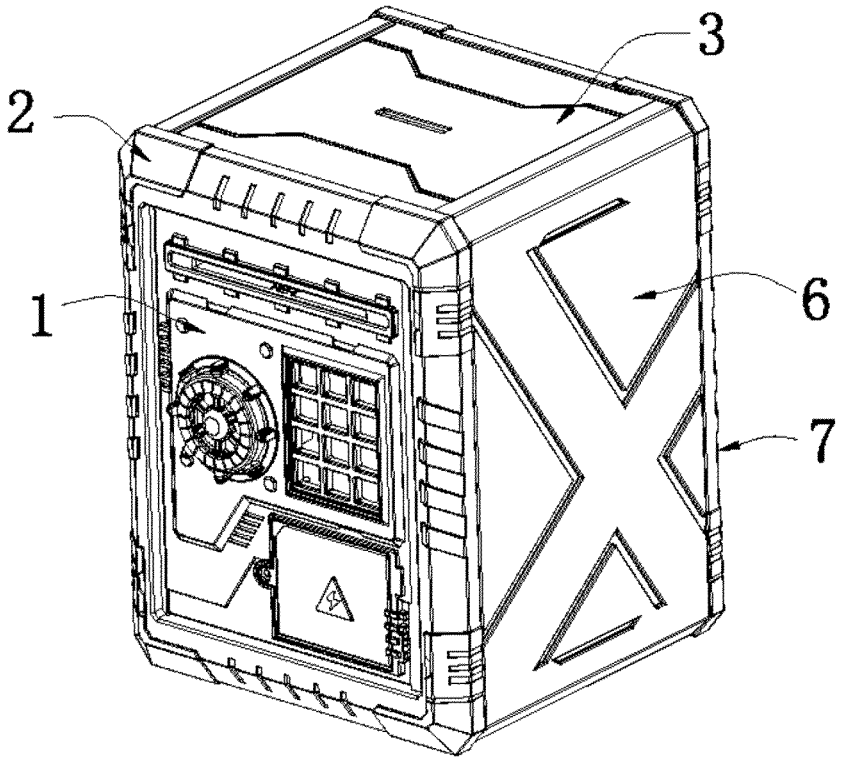
FIG. 1 is a diagram of a three-dimensional structure according to the present invention.
Figure 2:
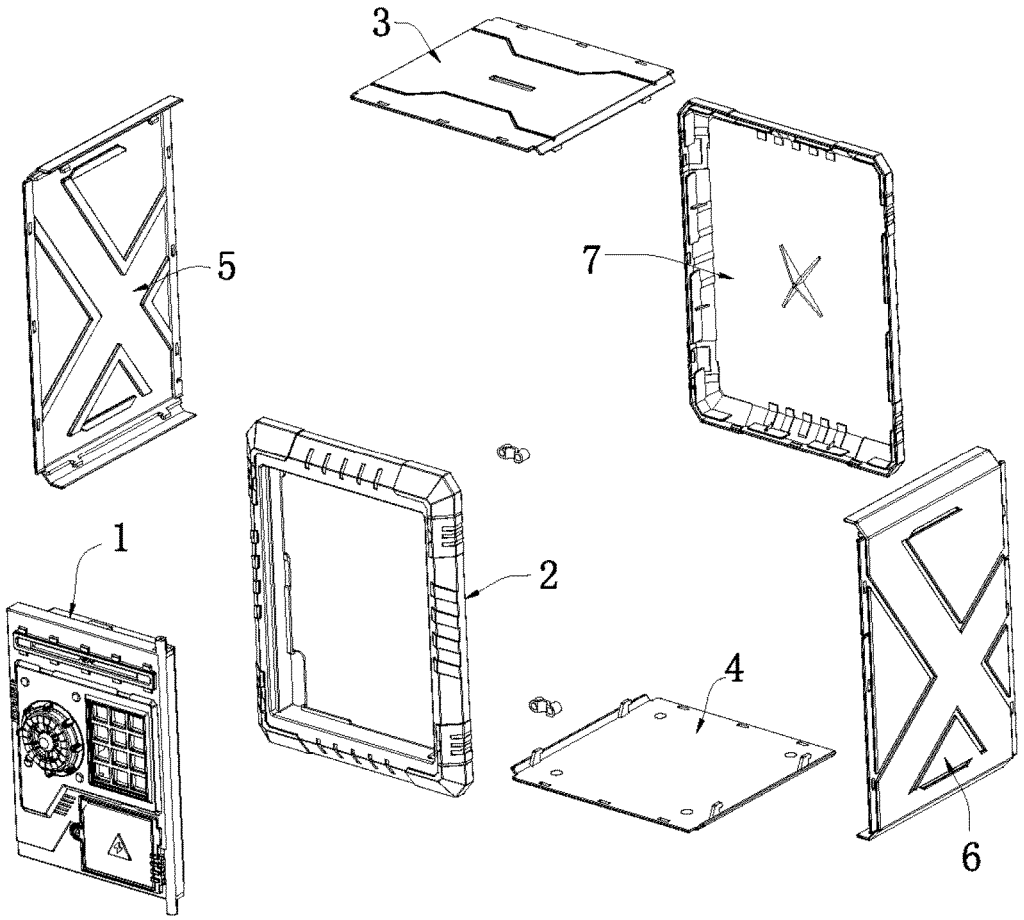
FIG. 2 is a diagram of a decomposition structure according to the present invention.
Figure 3:
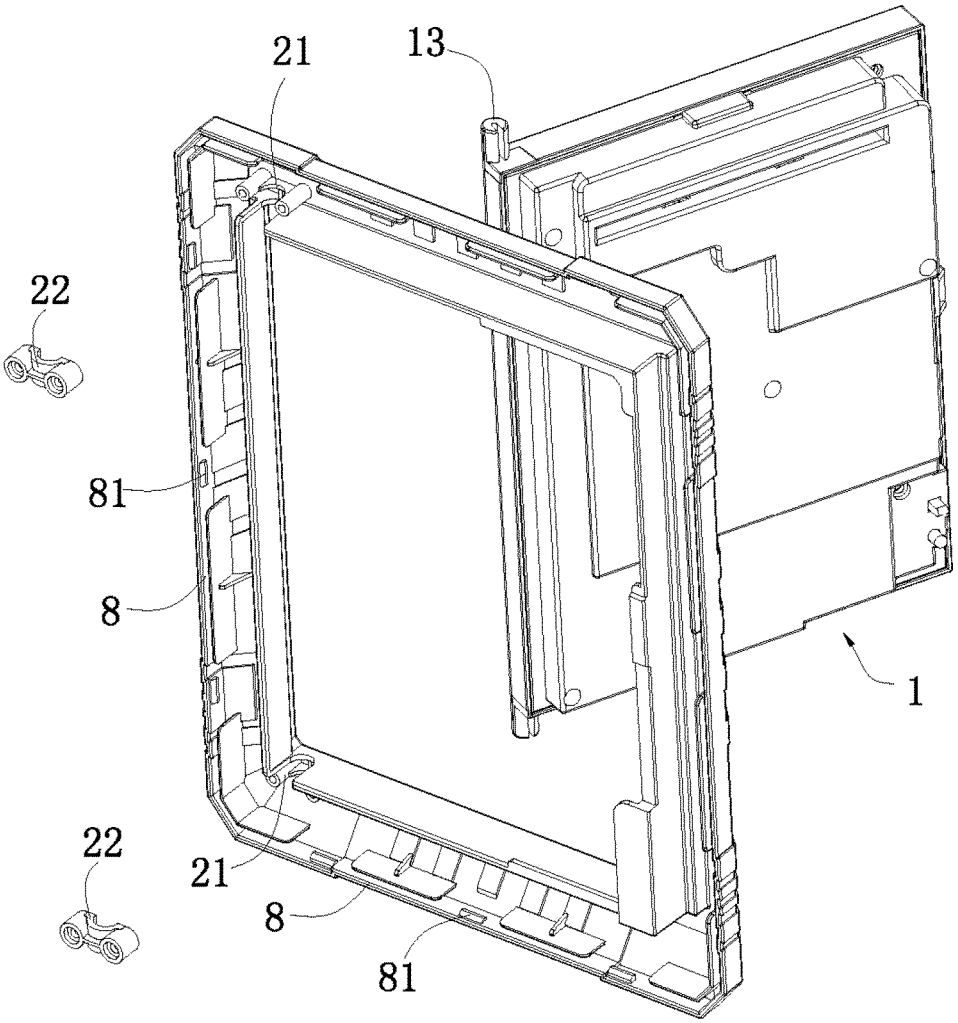
FIG. 3 is a diagram of structures of a door frame and a door according to the present invention.
Figure 4:
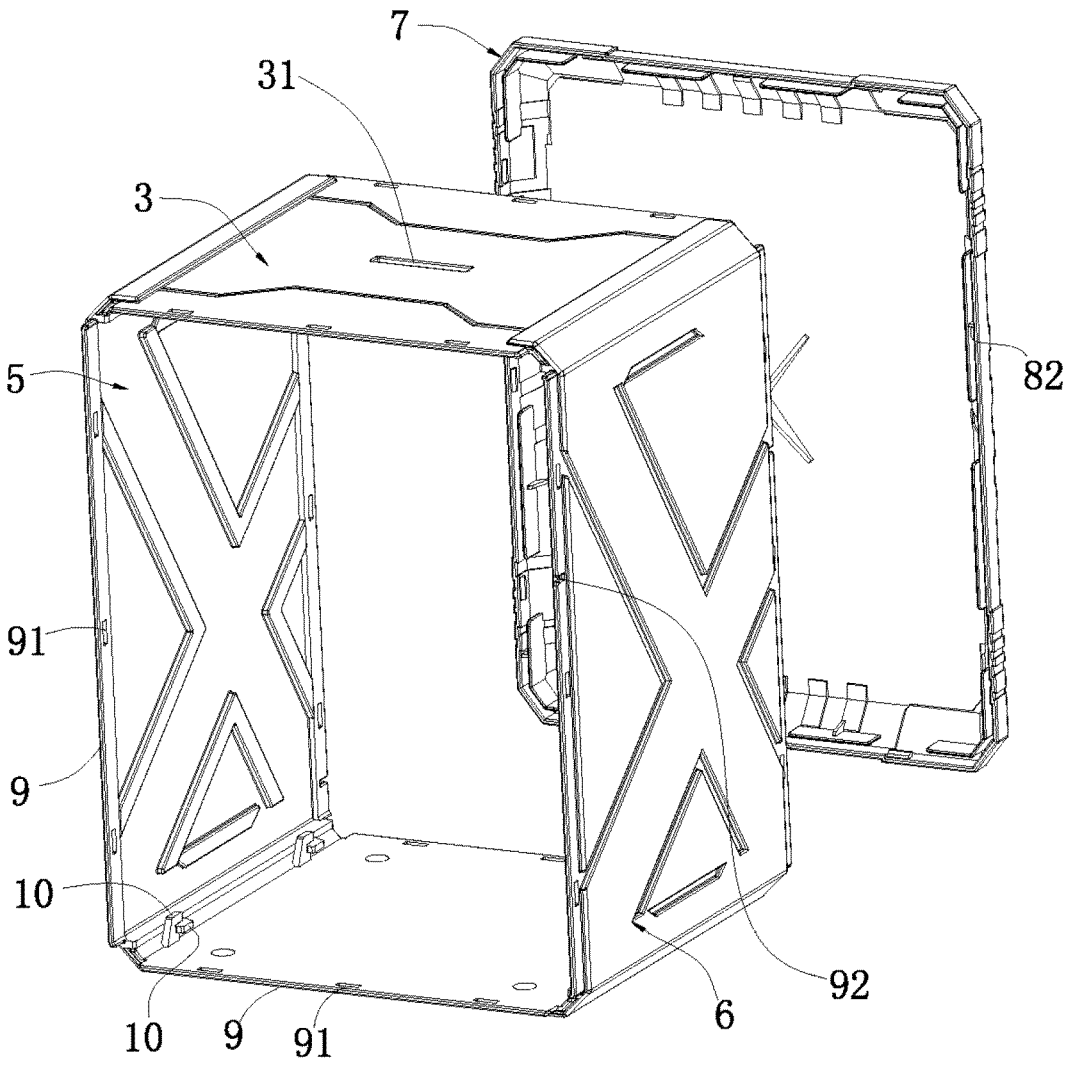
FIG. 4 is a diagram of structures of plates according to the present invention.
Figure 5:
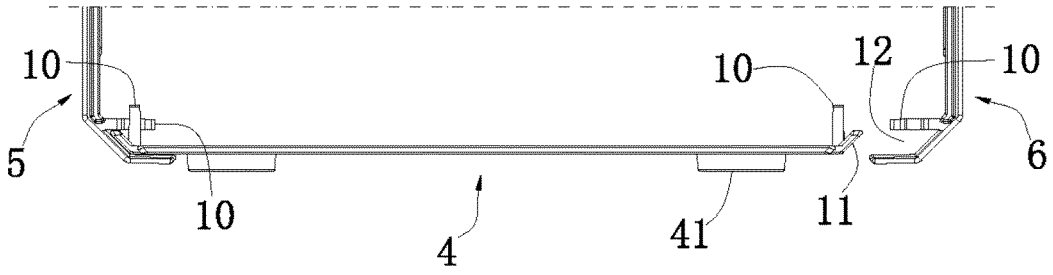
FIG. 5 is a diagram of structures of a bottom plate, a left side plate, and a right side plate according to the present invention.

Embodiment: With reference to FIG. 1 to FIG. 5, the embodiment of the present invention provides a money box toy assembly structure, including a body and a door 1. The body includes a door frame 2, a top plate 3, a bottom plate 4, a left side plate 5, a right side plate 6, and a back plate 7.

The door frame 2 and the back plate 7 are provided with slots 8 on relative surface periphery positions, and the slots 8 are provided with clamping protrusions 81; front and rear ends of the top plate 3, the bottom plate 4, the left side plate 5, and the right side plate 6 are provided with tongues 9 that are matched with the slots 8; and the tongues 9 are provided with clamping holes 91 that are matched with the clamping protrusions 81. Preferably, the clamping protrusion 81 is an inverted hook, and the clamping hole 91 is a square hole. The clamping protrusions and the clamping holes are well matched, and the design of the square hole is convenient for the accurate insertion of the clamping protrusion 81, to facilitate the assembly. Further, the tongue 9 is provided with a guide slot 92 that extends along an insertion and unplugging direction of the tongue, and the slot 8 is provided with a guide sheet 82 that is matched with the guide slot 92. The guide slot 92 and the guide sheet 82 are well matched, to guide the tongue 9 to be accurately inserted into the slot 8, and further simplify the assembly process. In addition, a position of the tongue 9 on each plate is adjusted, to ensure error-proofing functions and prevent misassembly.

Side hooks 10 on the top plate 3, the left side plate 5, and the right side plate 6, and side hooks 10 on the bottom plate 4, the left side plate 5, and the right side plate 6 are matched with each other. Preferably, the side hooks 10 on the top plate 3 and the bottom plate 4 are oriented in a same direction, the side hooks 10 on the left side plate 5 and the right side plate 6 are oriented in a same direction, and the side hook 10 on the top plate 3 is opposite to the side hook 10 on the left side plate 5. A mutual structure of the side hooks 10 between the adjacent plates that are facing the opposite direction can prevent relative sliding between the plates, is not easy to loosen, and can achieve stable connection without additional fasteners. In this way, the stability and the durability of the overall structure are improved.

Preferably, left and right ends of the top plate 3 and the bottom plate 4 are provided with chamfered flanges 11, and upper and lower ends of the left side plate 5 and the right side plate 6 are provided with sockets 12 that are matched with the shape of the chamfered flanges 11. Through the collaboration of the chamfered flanges 11 and the sockets 12, the left side plate 5, the right side plate 6, the top plate 3, and the bottom plate 4 are closely connected, with a more accurate alignment, to further enhance the stability of the structure.

The top plate 3 is provided with a coin slot 31. The coin slot is set for a user to put in coins or banknotes, to realize a basic function of the money box. Four corners of a bottom surface of the bottom plate 4 are provided with supporting feet 41, with good placement stability.

One side of the door 1 is provided with a hinged shaft 13, an inner side of the door frame 2 is provided with a hinged slot 21 that is matched with the hinged shaft 13, a notch of the hinged slot 21 is provided with a fixed base 22, and the hinged shaft 13 can be prevented from falling out of the hinged slot 21 through the fixed base 22.

During manufacturing, the door 1 may be pre-installed on the door frame 2, without occupying additional space. Components are stacked, to minimize the size and decrease the occupied volume during transportation to avoid excessive shipping costs. The compact structure also ensures convenient storage and portability for outdoor use.

During assembly, the top plate 3, the left side plate 5, the bottom plate 4, and the right side plate 6 are matched to form a square module through the side hooks 10. Then the tongue 9 on the rear end of the top plate 3, the left side plate 5, the bottom plate 4, and the right side plate 6 is aligned with and inserted into the slot 8 of the back plate 7; and the tongue 9 on the front end of the top plate 3, the left side plate 5, the bottom plate 4, and the right side plate 6 is aligned with and inserted into the slot 8 of the door frame 2. That is, through the cooperation of the slots 8 and the tongues 9, the clamping protrusions 81, the clamping holes 91, and the adjacent side hooks 10, the assembly can be completed without any additional tools, and the operation is simple and user-friendly.

According to the disclosure and guidance of the specification, a person skilled in the art may make changes and modifications to the foregoing embodiment. Therefore, the present invention is not limited to the specific embodiment revealed and described above, and some modifications and changes to the present invention shall also fall within the protection scope of the claims of the present invention. In addition, although some specific terms are used in the specification, the terms are used only for convenience and do not constitute any limitation on the present invention. According to the foregoing embodiment of the present invention, other structures obtained by adopting the same or similar structures thereof shall fall within the scope of protection of the present invention.

What is claimed is:

1. A money box toy assembly structure, comprising a body and a door, wherein the body comprises a door frame, a top plate, a bottom plate, a left side plate, a right side plate, and a back plate; the door frame and the back plate are provided with slots on relative surface periphery positions, and the slots are provided with clamping protrusions; front and rear ends of the top plate, the bottom plate, the left side plate, and the right side plate are provided with tongues that are matched with the slots, and the tongues are provided with clamping holes that are matched with the clamping protrusions; and side hooks on the top plate, the left side plate, and the right side plate, and side hooks on the bottom plate, the left side plate, and the right side plate are matched with each other.

2. The money box toy assembly structure according to claim 1, wherein left and right ends of the top plate and the bottom plate are provided with chamfered flanges, and upper and lower ends of the left side plate and the right side plate are provided with sockets that are matched with the shape of the chamfered flanges.

3. The money box toy assembly structure according to claim 1, wherein the side hooks on the top plate and the bottom plate are oriented in a same direction, the side hooks on the left side plate and the right side plate are oriented in a same direction, and the side hook on the top plate is opposite to the side hook on the left side plate.

4. The money box toy assembly structure according to claim 1, wherein the top plate is provided with a coin slot.

5. The money box toy assembly structure according to claim 1, wherein four corners of a bottom surface of the bottom plate are provided with supporting feet.

6. The money box toy assembly structure according to claim 1, wherein the tongue is provided with a guide slot that extends along an insertion and unplugging direction of the tongue, and the slot is provided with a guide sheet that is matched with the guide slot.

7. The money box toy assembly structure according to claim 1, wherein one side of the door is provided with a hinged shaft, an inner side of the door frame is provided with a hinged slot that is matched with the hinged shaft, and a notch of the hinged slot is provided with a fixed base.

* * * * *